US012631376B2

(12) United States Patent
Yamawaki et al.

(10) Patent No.: US 12,631,376 B2
(45) Date of Patent: May 19, 2026

(54) REFRIGERATION APPARATUS, CONTROL METHOD OF REFRIGERATION APPARATUS, AND TEMPERATURE CONTROL SYSTEM

(71) Applicant: SHINWA CONTROLS CO., LTD, Kawasaki (JP)

(72) Inventors: Masakatsu Yamawaki, Kawasaki (JP); Isamu Sasaki, Kawasaki (JP); Katsutoshi Sakai, Kawasaki (JP); Keisuke Sato, Kawasaki (JP)

(73) Assignee: Shinwa Controls Co., Ltd., Kawasaki (JP)

( * ) Notice: Subject to any disclaimer, the term of this patent is extended or adjusted under 35 U.S.C. 154(b) by 173 days.

(21) Appl. No.: 18/262,745

(22) PCT Filed: Jan. 28, 2022

(86) PCT No.: PCT/JP2022/003223

§ 371 (c)(1),
(2) Date: Jul. 25, 2023

(87) PCT Pub. No.: WO2022/163793

PCT Pub. Date: Aug. 4, 2022

(65) Prior Publication Data

US 2024/0167741 A1 May 23, 2024

(30) Foreign Application Priority Data

Jan. 29, 2021 (JP) ..... 2021-013566

(51) Int. Cl.
*F25B 13/00* (2006.01)
*F25B 41/20* (2021.01)

(52) U.S. Cl.
CPC ..... *F25B 41/20* (2021.01); *F25B 13/00* (2013.01); *F25B 2600/2501* (2013.01)

(58) Field of Classification Search
CPC ... F25B 41/20; F25B 13/00; F25B 2600/2501
See application file for complete search history.

(56) References Cited

U.S. PATENT DOCUMENTS

2013/0084553 A1* 4/2013 Kaneko ..... G09B 5/067 434/350
2016/0084553 A1* 3/2016 Seki ..... F25B 49/025 62/204
2019/0003755 A1* 1/2019 Crombie ..... F25B 43/00

FOREIGN PATENT DOCUMENTS

EP 3604891 A1 * 5/2020
JP S62155473 A * 7/1987
(Continued)

OTHER PUBLICATIONS

Ueno, Refrigerator Device, Jun. 5, 1992, JPH04161758A, Whole Document (Year: 1992).*
(Continued)

*Primary Examiner* — Larry L Furdge
(74) *Attorney, Agent, or Firm* — BURR PATENT LAW, PLLC

(57) ABSTRACT

Provided is a refrigeration apparatus including a refrigeration circuit, a liquid bypass circuit and a controller that opens a liquid bypass control valve when a discharge temperature of the refrigerant, which has been discharged from a compressor and does not yet flow into a condenser exceeds a threshold value, and closes the liquid bypass control valve when the discharge temperature is equal to or less than the threshold value. The refrigeration apparatus also regulates revolutions of the compressor such that an evaporation pressure of the refrigerant, which flows through a refrigeration circuit at a position downstream of an evaporator and upstream of the compressor, the position being downstream of a downstream-end connection point of a liquid bypass flow path, corresponds to a preset target evaporation pressure.

9 Claims, 4 Drawing Sheets

(56) References Cited

FOREIGN PATENT DOCUMENTS

| | | | | |
|---|---|---|---|---|
| JP | H04161758 | A | * | 6/1992 |
| JP | 2001168567 | A | * | 6/2001 |
| JP | 2001-280669 | A | | 10/2001 |
| JP | 2009-058200 | A | | 3/2009 |
| JP | 2014-145565 | A | | 8/2014 |
| JP | 2017-040396 | A | | 2/2017 |
| JP | 2020-134052 | A | | 8/2020 |
| WO | 2020/066000 | A1 | | 4/2020 |

OTHER PUBLICATIONS

Matsuoka et al., Refrigeration Cycle Device, Jul. 10, 1987, JPS62155473A, Whole Document (Year: 1987).*
Takada, Refrigerating Cycle Device, Oct. 10, 2001, JP2001280669A, Whole Document (Year: 2001).*
Itoyama et al., Cooler for Electronic Apparatus, Jun. 22, 2001, JP2001168567A, Whole Document (Year: 2001).*
English translation of the International Preliminary Report on Patentability (Chapter I) dated Aug. 10, 2023 (Application No. PCT/JP2022/003223).
International Search Report and Written Opinion (Application No. PCT/JP2022/003223) dated Mar. 8, 2022 (10 pages).

* cited by examiner

REFRIGERATION APPARATUS, CONTROL METHOD OF REFRIGERATION APPARATUS, AND TEMPERATURE CONTROL SYSTEM

TECHNICAL FIELD

The present invention relates to: a refrigeration apparatus having a compressor, a condenser, an expansion valve, and an evaporator; a control method of the refrigeration apparatus; and a temperature control system comprising the refrigeration apparatus.

BACKGROUND ART

A temperature control system which comprises: a refrigeration apparatus having a compressor, a condenser, an expansion valve, and an evaporator; and a fluid circulation apparatus that circulates a fluid such as water, brine, etc., is known (for example, JP2014-145565A). Such a temperature control system cools the fluid circulated by the fluid circulation apparatus by the evaporator of the refrigeration apparatus.

SUMMARY OF THE INVENTION

The aforementioned temperature control system may have relatively a large size, because it comprises the refrigeration apparatus and the fluid circulation apparatus.

However, such a system is desirably compact in order to facilitate transportation, to reduce an installation space, etc. The refrigeration apparatus can be provided with an accumulator for reducing liquid back, for example. Since the accumulator has relatively a large size, it enlarges the system as a whole. If the liquid back can be reduced without using such an accumulator, the system can be advantageously made compact.

In the refrigeration apparatus, when a temperature of a refrigerant suctioned by a compressor excessively increases, the compressor may burn out. In addition, the increase in temperature of the refrigerant suctioned by the compressor may increase a discharge temperature, which is undesirable for an entire circuit. In order to avoid this, a liquid bypass, which bypasses a refrigerant downstream of a condenser to a position upstream of the compressor, is sometimes used. However, when the refrigerant is bypassed by the liquid bypass circuit, an amount of the refrigerant flowing toward an evaporator decreases, which may lower refrigeration capacity. In this case, a rotation speed of the compressor may be increased to increase an amount of the refrigerant to be discharged. When decrease in amount of the refrigerant flowing toward the evaporator is compensated by an amount of the refrigerant discharged from the compressor, a sufficient amount of refrigerant including a surplus is generally filled into the refrigeration apparatus in order to obtain both proper bypass and refrigeration capacity.

However, the use of the above surplus refrigerant may also cause enlargement of the system as a whole. In addition, the use of a large amount of refrigerant should be avoided in consideration of environmental burden. Moreover, the liquid bypass circuit may increase risk of liquid back, because a refrigerant in a gas-liquid mixture state is sent to a position upstream of the compressor. Thus, the liquid bypass circuit is often used together with an accumulator. This enlarges the system as a whole.

The present invention has been made in consideration of the above circumstances. The object of the present invention is to provide a refrigeration apparatus, a control method of the refrigeration apparatus, and a temperature control system, which are capable of suitably reducing liquid back of a refrigerant in the refrigeration apparatus, of suitably reducing excessive increase in temperature of a refrigerant to be suctioned into a compressor while reducing an amount of the refrigerant to be used, and of performing a proper cooling operation, even when a capacity of an accumulator is reduced or when no accumulator is used.

Solution to Problem

A refrigeration apparatus according to one embodiment of the present invention is a refrigeration apparatus comprising: a refrigeration circuit in which a compressor, a condenser, an expansion valve, and an evaporator are connected in this order by a pipe to circulate a refrigerant therethrough; a liquid bypass circuit having a liquid bypass flow path, which branches off from the refrigeration circuit at a position downstream of the condenser and upstream of the expansion valve to be connected to a position downstream of the evaporator and upstream of the compressor, and a liquid bypass control valve provided on the liquid bypass flow path to control flow of the refrigerant in the liquid bypass flow path; and a controller that controls the liquid bypass control valve and revolutions of the compressor; wherein: when a discharge temperature of the refrigerant, which has been discharged from the compressor and does not yet flow into the condenser, exceeds a threshold value, the controller opens the liquid bypass control valve and regulates the revolutions of the compressor such that an evaporation pressure of the refrigerant, which flows through the refrigeration circuit at a position downstream of the evaporator and upstream of the compressor, the position being downstream of a downstream-end connection point of the liquid bypass flow path, corresponds to a preset target evaporation pressure; or when a discharge temperature of the refrigerant, which has been discharged from the compressor and does not yet flow into the condenser, is equal to or less than a threshold value, the controller closes the liquid bypass control valve and regulates the revolutions of the compressor such that an evaporation pressure of the refrigerant, which flows through the refrigeration circuit at a position downstream of the evaporator and upstream of the compressor, the position being downstream of a downstream-end connection point of the liquid bypass flow path, corresponds to a preset target evaporation pressure.

A control method of a refrigeration apparatus according to one embodiment of the present invention is a control method of a refrigeration apparatus comprising: a refrigeration circuit in which a compressor, a condenser, an expansion valve, and an evaporator are connected in this order by a pipe to circulate a refrigerant therethrough; and a liquid bypass circuit having a liquid bypass flow path, which branches off from the refrigeration circuit at a position downstream of the condenser and upstream of the expansion valve to be connected to a position downstream of the evaporator and upstream of the compressor, and a liquid bypass control valve provided on the liquid bypass flow path to control flow of the refrigerant in the liquid bypass flow path;

the control method comprising the steps of:

operating the refrigeration apparatus; and when a discharge temperature of the refrigerant, which has been discharged from the compressor and does not yet flow into the condenser, exceeds a threshold value, opening the liquid bypass control valve and regulating revolutions of the compressor such that an evaporation pressure of the refrigerant, which flows through the refrigeration circuit at a position downstream of the evaporator and upstream of the compressor, the position being downstream of a downstream-end connection point of the liquid bypass flow path, corresponds to a preset target evaporation pressure; or when a discharge temperature of the refrigerant, which has been discharged from the compressor and does not yet flow into the condenser, is equal to or less than a threshold value, closing the liquid bypass control valve and regulating revolutions of the compressor such that an evaporation pressure of the refrigerant, which flows through the refrigeration circuit at a position downstream of the evaporator and upstream of the compressor, the position being downstream of a downstream-end connection point of the liquid bypass flow path, corresponds to a preset target evaporation pressure.

A temperature control system according to one embodiment of the present invention is a temperature control system comprising: the aforementioned refrigeration apparatus; and a fluid circulation apparatus that sends a fluid, which has heat-exchanged in the evaporator, to a temperature control target, and returns the fluid, which has passed through the temperature control target, to the evaporator for further heat-exchange, the fluid circulation apparatus having a heater at a position downstream of the temperature control target and upstream of the evaporator.

The present invention can suitably reduce the liquid back of the refrigerant in the refrigeration apparatus, can suitably reduce excessive increase in temperature of the refrigerant to be suctioned into the compressor while reducing an amount of the refrigerant to be used, and can perform a proper cooling operation, even when a volume of an accumulator is reduced or the accumulator is not used.

MODE FOR CARRYING OUT THE INVENTION

One embodiment of the present invention will be described herebelow.

Figure 1:
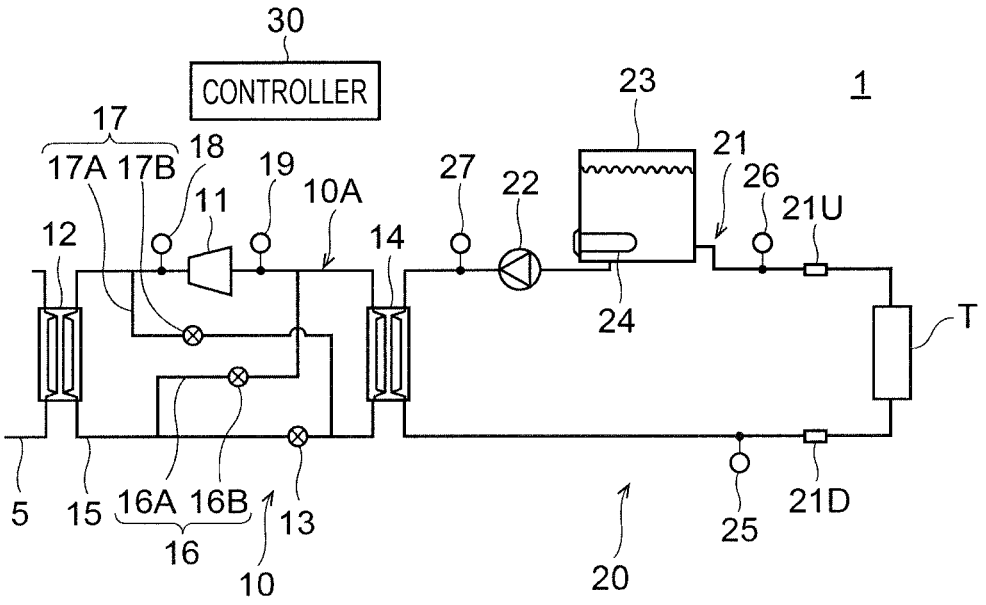
FIG. 1 is a view showing a schematic structure of a temperature control system according to one embodiment of the present invention.

FIG. 1 is a schematic view of a temperature control system 1 according to one embodiment of the present invention. The temperature control system 1 shown in FIG. 1 comprises a refrigeration apparatus 10, and a fluid circulation apparatus 20. A controller 30 controls the refrigeration apparatus 10 and the fluid circulation apparatus 20.

The refrigeration apparatus 10 controls a temperature of a fluid circulated by the fluid circulation apparatus 20 by a refrigerant. The fluid circulation apparatus 20 supplies the fluid whose temperature has been controlled by the refrigeration apparatus 10 to a temperature control target T.

The fluid circulation apparatus 20 is configured to circulate the fluid having passed through the temperature control target T. After the fluid has returned from the temperature control target T, its temperature is again controlled by the refrigeration apparatus 10. The fluid circulated by the fluid circulation apparatus 20 is brine, for example, but may be another fluid such as water.

In response to a user's operation, for example, the controller 30 sets a temperature of the fluid to be supplied to the temperature control target T, and controls respective parts of the refrigeration apparatus 10 and respective parts of the fluid circulation apparatus 20, such that a temperature of the fluid corresponds to the set temperature. The refrigeration apparatus 10, the fluid circulation apparatus 20, and the controller 30 are described in detail herebelow.

(Refrigeration Apparatus)

The refrigeration apparatus 10 comprises: a refrigeration circuit 10A in which a compressor 11, a condenser 12, an evaporation valve 13, and an evaporator 14 are connected in this order by a pipe 15 to circulate a refrigerant therethrough; a liquid bypass circuit 16 connected to the refrigeration circuit 10A; a gas bypass circuit 17 connected to the refrigeration circuit 10A; a discharge temperature sensor 18; and an evaporation pressure sensor 19.

In the refrigeration circuit 10A, the compressor 11 is configured to compress a refrigerant in a gaseous state having a low temperature and a low pressure, which has flown out from the evaporator 14, into a gaseous state having a high temperature and a high pressure, and to supply it to the condenser 12. The condenser 12 is configured to cool and condense the refrigerant having been compressed by the compressor 11 by cooling water, into a liquid state having a predetermined cooled temperature and a high pressure, and to supply it to the expansion valve 13.

Water or another refrigerant may be used as the cooling water of the condenser 12. A reference numeral 5 in FIG. 1 represents a cooling water pipe that supplies cooling water to the condenser 12. The condenser 12 may be an air-cooled condenser.

The expansion valve 13 is configured to expand and decompress the refrigerant having been supplied from the condenser 12, into a gas-liquid mixed state having a lower temperature and a low pressure, and to supply it to the evaporator 14. The evaporator 14 heat-exchanges the refrigerant having been supplied from the expansion valve 13 with the fluid of the fluid circulation apparatus 20. The refrigerant, which has heat-exchanged with the fluid into a gaseous state having a low temperature and a low pressure, flows out from the evaporator 14 to be compressed by the compressor 11 again.

The liquid bypass circuit 16 has a liquid bypass flow path 16A, which branches off from the refrigeration circuit 10 at a position downstream of the condenser 12 and upstream of the expansion valve 13 to be connected to a position downstream of the evaporator 14 and upstream of the compressor 11, and a liquid bypass control valve 16B provided on the liquid bypass flow path 16A to control a flow of the refrigerant in the liquid bypass flow path 16A.

When the liquid bypass control valve 16B is opened, the refrigerant flows from the position downstream of the condenser 12 and upstream of the expansion valve 13 to the position downstream of the evaporator 14 and upstream of the condenser 11.

The gas bypass circuit 17 has a gas bypass flow path 17A, which branches off from the refrigeration circuit 10A at a position downstream of the compressor 11 and upstream of the condenser 12 to be connected to a position downstream of the expansion valve 13 and upstream of the evaporator 14, and a gas bypass control valve 17B provided on the gas bypass flow path 17A to control a flow of the refrigerant in the gas bypass flow path 17A.

When the gas bypass control valve 17B is opened, the refrigerant flows from the position downstream of the compressor 11 and upstream of the condenser 12 to the position downstream of the expansion valve 13 and upstream of the evaporator 14.

The discharge temperature sensor 18 detects a temperature of the refrigerant which has been discharged from the compressor 11 and does not yet flow into the condenser 12.

The evaporation pressure sensor 19 detects, as an evaporation pressure, a pressure of the refrigerant which flows through the refrigeration circuit 10A at a position downstream of the evaporator 14 and upstream of the compressor 11, the position being downstream of a downstream-end connection point of the liquid bypass flow path 16A.

Information detected by the discharge temperature sensor 18 and information detected by the evaporation pressure sensor 19 are inputted to the controller 30. The liquid bypass control valve 16B of the liquid bypass circuit 16 is controlled by the controller 30 based on a discharge temperature detected by the discharge temperature sensor 18, and the gas bypass control valve 17B of the gas bypass circuit 17 is controlled by the controller 30 based on an evaporation pressure detected by the evaporation pressure sensor 19, details of which are described below. In addition, revolutions of the compressor 11 is controlled by the controller 30 based on the evaporation pressure detected by the evaporation pressure sensor 19.

The refrigeration apparatus 10 in this embodiment is not provided with an accumulator. However, the refrigeration apparatus 10 may comprise an accumulator.

(Fluid Circulation Apparatus)

The fluid circulation apparatus 20 comprises a main flow-path pipe 21 having a return port 21U and a supply port 21D. The fluid circulation apparatus 20 is connected to the temperature control target T through flow path pipes respectively connected to the return port 21U and the supply port 21D. The main flow-path pipe 21 of the fluid circulation apparatus 20 is connected to the evaporator 14. The fluid circulation apparatus 20 sends the liquid, which has flown through the main flow-path pipe 21 and has heat-exchanged in the evaporator 14, to the temperature control target T. Thereafter, the fluid circulation apparatus 20 is configured to return the fluid, which has passed through the temperature control target T, to the evaporator 14 for further heat-exchange.

The fluid circulation apparatus 20 further comprises a pump 22, a tank 23, a heater 24, and first to third temperature sensors 25 to 27, which are provided on the main flow-path pipe 21.

The pump 22 constitutes a part of the main flow-path pipe 21 and generates a driving force for circulating a fluid. The pump 22 is located on the main flow-path pipe 21 at a position upstream of a connection point to the evaporator 14, but its position is not particularly limited.

The tank 23 and the heater 24 are located on the main flow-path pipe 21 at positions upstream of the connection point to the evaporator 14. Namely, in the fluid circulation apparatus 20 connected to the temperature control target T, the tank 23 and the heater 24 are located at positions downstream of the temperature control target T and upstream of the evaporator 14.

The tank 23 is provided for storing a certain amount of liquid, and constitutes a part of the main flow-path pipe 21. The heater 24 is provided for heating the fluid. In this embodiment, the hater 24 is located inside the tank 23, but the heater 24 may be located outside the tank 23. The heater 24 is electrically connected to the controller 30 so that its heating capacity is controlled by the controller 30.

The first temperature sensor 25 detects a temperature of the fluid which flows through the main flow-path pipe 21 at a position downstream of the connection point to the evaporator 14. The second temperature sensor 26 detects a temperature of the fluid which has passed through the temperature control target T and flows through a position upstream of the heater 24. In more detail, the second temperature sensor 26 detects a temperature of the fluid which has passed through the temperature control target T to flow through a position upstream of the heart 24, and does not yet flow into the tank 23.

The third temperature sensor 27 detects a temperature of the fluid which flows through the fluid circulation apparatus 20 at a position downstream of the heater 24 and does not yet pass through the evaporator 14.

The first to third temperature sensors 25 to 27 are electrically connected to the controller 30, and temperature information detected by each of the sensors 25 to 27 is transmitted to the controller 30.

(Controller)

The controller 30 is a controller that controls operations of the refrigeration apparatus 10 and the fluid circulation apparatus 20. The controller 30 may comprise, for example, a computer having a CPU, ROM and the like. In this case, the controller 30 performs various processes based on a program stored in the ROM. The controller 30 may also comprise another processor and an electric circuit (e.g., FPGA (Field Programmable Gate Array), etc.).

Figure 2:
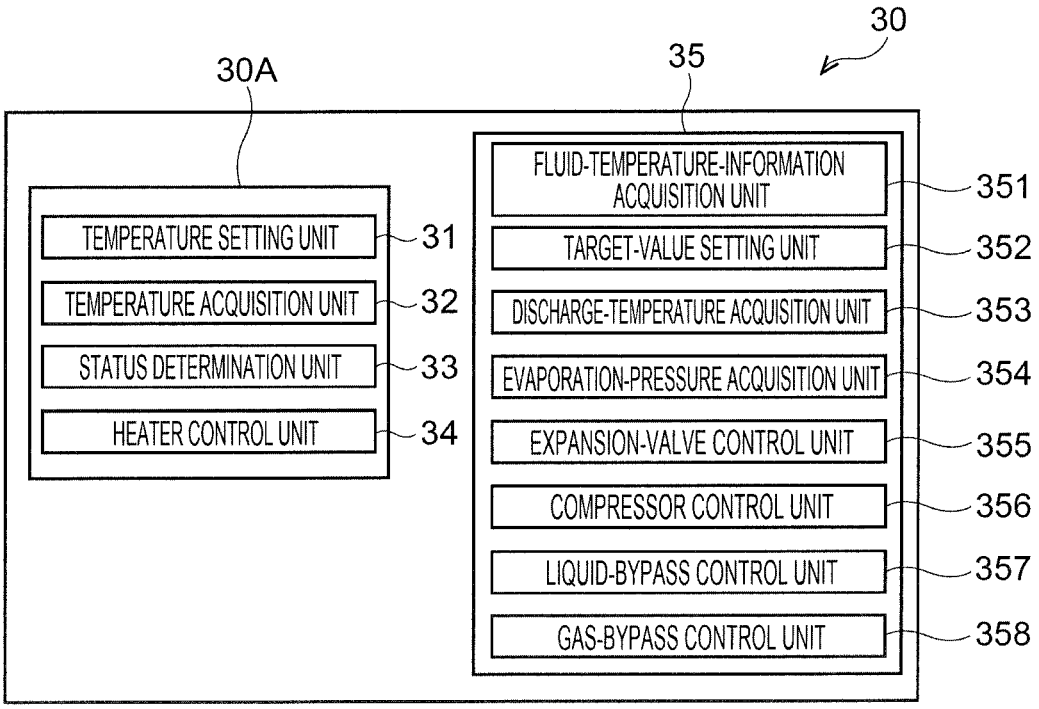
FIG. 2 is a bock diagram showing a functional structure of a controller constituting the temperature control system shown in FIG. 1.

FIG. 2 is a block diagram showing a functional structure of the controller 30. As shown in FIG. 2, the controller 30 has a fluid circulation apparatus control module 30A and a refrigeration apparatus control module 35. The fluid circulation apparatus control module 30A and the refrigeration apparatus control module 35 may be included in a single computer or in respective separate computers.

"Fluid Circulation Apparatus Control Module"

The fluid circulation apparatus control module 30A is first described in detail.

The fluid circulation apparatus control module 30A has a temperature setting unit 31, a temperature acquisition unit 32, a status determination unit 33, and a heater control unit 34. These functional units are realized, for example, by executing a program.

The temperature setting unit 31 sets and holds, in response to a user's operation, a temperature of a fluid to be supplied to the temperature control target T as a set temperature. In addition, the temperature setting unit 31 sets and holds, in response to a user's operation, a target temperature of a return temperature of the fluid, which flows downstream of the heater 24 and does not yet pass through the evaporator 14.

The target temperature is set within a temperature range at which a refrigerant, which has heat-exchanged with the fluid of the fluid circulation apparatus 20 and flows out from the evaporator 14, is made into superheated vapor. The target temperature is suitably set based on a refrigeration capacity of the refrigeration apparatus 10, a type refrigerant, a target evaporation temperature of the refrigerant which is described later, etc. When a return temperature of the fluid, which flows downstream of the heater 24 and does not yet pass through the evaporator 14, becomes such a target temperature or higher, the risk of refrigerant containing a liquid phase returning to the compressor 11, i.e., the liquid back can be avoided.

The temperature acquisition unit 32 is configured to acquire information of temperatures detected by the first to third temperature sensors 25 to 27, and to transmit the temperature information acquired from the first to third temperature sensors 25 to 27 to the status determination unit 33, the heater control unit 34, and the refrigeration apparatus control module 35.

The status determination unit 33 determines a status of the fluid circulation apparatus 20 based on the temperature information detected by the first to third temperature sensors 25 to 27.

In this embodiment, the status determination unit 33 determines whether the fluid circulation apparatus 20 is in a no-load operation or a no-load operation transition operation for transitioning into the no-load operation, based on the temperature information detected by the second temperature sensor 26. In detail, the status determination unit 33 determines whether a temperature of the fluid, which has passed through the temperature control target T and flows upstream of the heater 24 is lower than a predetermined temperature, based on the temperature information detected by the second temperature sensor 26. When the temperature of the fluid is lower than the predetermined temperature, the status determination unit 33 determines that the fluid circulation apparatus 20 is in the no-load operation or the no-load operation transition operation.

The no-load operation means a status wherein the temperature control target T does not heat-exchange with the fluid. The no-load operation transition operation means a status in the course of transitioning into the no-load operation, wherein the temperature control target T less heat-exchanges with the fluid than usual.

For example, suppose that the temperature control target T is an apparatus that generates heat. In this case, when the fluid circulation apparatus 20 is in the normal operation, a temperature controlled fluid heat-exchanges with the temperature control target T. After having passed through the temperature control target T, the fluid has a temperature higher than the temperature before heat exchange. On the other hand, when the temperature control target T is stopped so that heat generation gradually decreases, the temperature control target T less heat-exchanges with the fluid than in the normal operation, and finally the temperature control target T does not heat-exchange with the fluid any more.

Namely, the no-load operation transition operation means that, when the temperature control target T which is an apparatus is stopped, for example, the temperature control target T less heat-exchanges with the fluid than usual, due to this stop. The no-load operation means that, when the temperature control target T which is an apparatus is stopped, for example, the temperature control target T does not substantially heat-exchange with the fluid.

The predetermined temperature based on which the whether the fluid circulation apparatus 20 is determined to be in the no-load operation or the no-load operation transition operation is a temperature equal to or higher than a set temperature of the fluid to be supplied to the temperature control target T, and is suitably selected in relation to the temperature of the temperature control target T.

The status determination unit 33 determines whether a return temperature of the fluid, which flows downstream of the heater 24 and does not yet pass through the evaporator 14, is lower than the target temperature. When the return temperature is lower than the target temperature, the status determination unit 33 generates a liquid back risk signal. When such a liquid back risk signal is generated, an alarm may be issued, for example. In addition, the status determination unit 33 detects lack of refrigeration capacity by comparing temperature information detected by the first temperature sensor 25 and the set temperature with each other.

The heater control unit 34 activates the heater 24 to heat the fluid by the heater 24, when the status determination unit 33 determines that the fluid circulation apparatus 20 is in the no-load operation or the no-load operation transition operation.

The heater control unit 34 in this embodiment activates the heater 24, when the fluid circulation apparatus 20 is in the no-load operation or the no-load operation transition operation, as described above. Thereafter, the heater control unit 34 is configured to control a heating capacity of the heater 24.

When controlling the heating capacity of the heater 24, the control unit 30 in this embodiment calculates, by means of the heater control unit 34, a heating capacity Q by which a temperature of the fluid to be passed through the evaporator 14 corresponds to a target temperature Tt, from the following formula (1).

$$Q=m\times Cp\times(Tt-Ts) \quad (1)$$

Here, Ts represents a set temperature (° C.) of the fluid to be supplied to the temperature control target T, Tt represents a target temperature (° C.) of the fluid which flows through the fluid circulation apparatus 20 at a position downstream of the heater 24 and does not yet pass through the evaporator 14, m represents a weight flow rate (kg/s) of the fluid circulated by the fluid circulation apparatus 20, and Cp represents a specific heat (J/kg° C.) of the fluid. The weight flow rate m may be detected by a flow-rate sensor or may be specified by a status of the pump 22. The specific heat Cp of the fluid is held by the control unit 30 in advance.

The control unit 30 controls the heating capacity of the heater 24 based on the heating capacity Q calculated based on the formula (1) by means of the heater control unit 34. Specifically, the heater control unit 34 controls the heating capacity of the heater 24 such that it becomes equal to or more than the heating capacity Q calculated based on the formula (1). The heating capacity as a control target value may be determined in advance based on the heating capacity Q previously calculated based on the formula (1), and may be stored in the control unit 30 in advance.

There is a possibility that the heating capacity Q calculated based on the formula (1) exceeds a maximum heating capacity of the heater 24. In this case, the controller 30 controls the heater 24 to its maximum heating capacity.

In this embodiment, the heater 24 is controlled such that the heating capacity of the heater 24 becomes equal to or more than the heating capacity Q calculated based on the formula (1), as described above. However, the heater 24 may be controlled such that its heating capacity becomes equal to the heating capacity Q itself calculated based on the formula (1). When the heating capacity of the heater 24 is controlled to be equal to or more than the heating capacity Q calculated based on the formula (1), it is desirable to set a value that is not excessively greater than the heating capacity Q (for example, 2Q or less).

The reason for activating the heater 24 when the fluid circulation apparatus 20 is in the no-load operation or the no-load operation transition operation is to avoid liquid back. Namely, if the fluid having a low temperature passes through the evaporator 14, the refrigerant of the refrigeration apparatus 10 insufficiently evaporates, so that liquid back may occur. The larger the heating capacity of the heater 24, the lower the liquid back risk. However, when the heating capacity of the heater 24 is excessively large, seizure or the like of the compressor 11 may disadvantageously occur. Thus, the heating capacity of the heater 24 is desirably not excessively large.

The controller 30 controls the heating capacity of the heater 24 such that it becomes equal to or more than the heating capacity Q calculated based on the formula (1). Thereafter, when a temperature of the fluid, which flows downstream of the heater 24 and does not yet pass through the evaporator 14, does not reach the target temperature Tt or more, the controller 30 may regulate the heater 24.

Namely, after the heating capacity of the heater 24 has been controlled, it may be determined whether a return temperature of the fluid, which flows downstream of the heater 24 and does not yet pass through the evaporator 14, is lower than the aforementioned target temperature, based on the temperature information detected by the third temperature sensor 27. When the return temperature is lower than the target temperature and a liquid back risk signal is generated, the heater 24 may be regulated. At this time, an alarm may be issued simultaneously with the regulation of the heater 24.

"Refrigeration Apparatus Control Module"

Next, the refrigeration apparatus control module 35 is described in detail.

The refrigeration apparatus control module 35 has a fluid-temperature-information acquisition unit 351, a target-value setting unit 352, a discharge-temperature acquisition unit 353, an evaporation-pressure acquisition unit 354, an expansion-valve control unit 355, a compressor control unit 356, a liquid-bypass control unit 357, and a gas-bypass control unit 358. These functional units are realized, for example, by executing a program.

The fluid-temperature-information acquisition unit 351 acquires the aforementioned set temperature set by the temperature setting unit 31 of the fluid circulation apparatus control module 30A, and acquires a detected temperature of the fluid detected by the first temperature sensor 25 of the fluid circulation apparatus 20. The fluid-temperature-information acquisition unit 351 is configured to transmit the acquired set temperature to the target-value setting unit 352 and the expansion-valve control unit 355, and to transmit the acquired detected temperature to the expansion-valve control unit 355.

The target-value setting unit 352 sets a reference revolutions of the compressor 11 based on the set temperature transmitted from the fluid-temperature-information acquisition unit 351, sets a target evaporation pressure corresponding to the reference revolutions, and further sets a threshold value of a discharge temperature of a refrigerant discharged from the compressor 11.

The aforementioned set temperature, which is a control target value of a temperature of the fluid, may be set at 10° C., 0° C., −10° C., etc., for example. The target-value setting unit 352 sets, for example, reference revolutions of the compressor 11 based on such a set temperature, and a target evaporation pressure corresponding thereto. This regulates a desired refrigeration capacity. The lower a set temperature, the higher values of the reference revolutions and the target evaporation pressure are set. A threshold value of the discharge temperature is set at a certain value, such as 80° C., in this embodiment, and is recorded in advance.

The discharge-temperature acquisition unit 353 acquires a temperature of the refrigerant which is discharged from the compressor 11 and does not yet flow into the condenser 12, and transmits information related to the obtained temperature of the refrigerant to the liquid-bypass control unit 357.

The evaporation-pressure acquisition unit 354 acquires, from the evaporation pressure sensor 19, an evaporation pressure of the refrigerant having flown out from the evaporator 14, and transmits acquired information related to the evaporation pressure to the compressor control unit 356 and the gas-bypass control unit 358.

The expansion-valve control unit 355 is configured to acquire a set temperature set by the temperature setting unit 31 from the fluid-temperature-information acquisition unit 351, as described above, and to acquire a detected temperature of the fluid detected by the first temperature sensor 25 of the fluid circulation apparatus 20. The expansion-valve control unit 355 is configured to regulate, as a function of a difference between the set temperature and the detected temperature, an opening degree of the expansion valve 13 such that the detected temperature corresponds to the set temperature.

The expansion-valve control unit 355 regulates the opening degree of the expansion valve 13 by PID control in this embodiment. However, a control method of the expansion valve 13 by the expansion-valve control unit 355 is not particularly limited.

The compressor control unit 356 acquires information related to the reference revolutions of the compressor 11 set by the target-value setting unit 352 and the target evaporation pressure corresponding thereto, and acquires the information of the evaporation pressure of the refrigerant having flown out from the evaporator 41 from the evaporation-pressure acquisition unit 354 as described above. The compressor control unit 356 is configured to control the revolutions of the compressor 11 based on the information.

In detail, when the operation of the refrigeration apparatus is started, the compressor control unit 356 first controls the revolutions of the compressor 11 to the reference revolutions set by the target setting unit 352. After the revolutions of the compressor 11 has been controlled to the reference revolutions (after activation), the compressor control unit 356 constantly monitors an evaporation pressure of the refrigerant obtained from the evaporation-pressure acquisition unit 354. When the evaporation pressure deviates from the target evaporation pressure, the compressor control unit 356 is configured to regulate the revolutions of the compressor 11.

In more detail, when the evaporation pressure of the refrigerant exceeds the target evaporation pressure, the compressor control unit 356 increases the revolutions of the compressor 11 such that the evaporation pressure of the refrigerant corresponds to the target evaporation pressure. On the other hand, when the evaporation pressure of the refrigerant falls below the target evaporation temperature, the compressor control unit 356 decreases the revolutions of the compressor 11 such that the evaporation pressure of the refrigerant corresponds to the target evaporation pressure. Namely, the controller 30 is configured to regulate the revolutions of the compressor 11 by the compressor control unit 356 such that the evaporation pressure of the refrigerant corresponds to the target evaporation pressure.

The compressor control unit 356 in this embodiment regulates the revolutions of the compressor 11 by PI control such that the evaporation pressure of the refrigerant corresponds to the target evaporation pressure. This reduces impairment of control stability caused by excessive change in revolutions. However, a control method by the compressor control unit 356 is not particularly limited.

The compressor control unit 356 decreases the revolutions of the compressor 11 when the evaporation pressure of the refrigerant falls below the target evaporation pressure, but the compressor control unit 356 has a lower limit value of the revolutions. Namely, even when the evaporation pressure of the refrigerant falls below the target evaporation pressure while the revolutions of the compressor 11 is lowered to the lower limit value, the compressor control unit 356 will not decrease the revolutions of the compressor 11 below the lower limit value.

The liquid-bypass control unit 357 acquires the information of the threshold value (for example, 80° C.) of the discharge temperature set by the target-value setting unit 352, and acquires information of a temperature of the refrigerant, which has been discharged from the compressor 11 and does not yet flow into the condenser 12, from the discharge temperature sensor 18. The liquid-bypass control unit 357 is configured to open the liquid bypass control valve 16B when the discharge temperature of the refrigerant based on the information from the discharge temperature sensor 18 exceeds the threshold value, and to close the liquid bypass control valve 16B when the discharge temperature of the refrigerant is equal to or lower than the threshold value.

Namely, the controller 30 is configured to open the liquid bypass control valve 16B when the discharge temperature of the refrigerant, which has been discharged from the compressor 11 and does not yet flow into the condenser 12, exceeds the threshold value, and to close or keep closed the liquid bypass control valve 16B when the discharge temperature is equal to or lower than the threshold value.

When the discharge temperature of the refrigerant exceeds the threshold value, the liquid-bypass control unit 357 in this embodiment regulates the opening degree of the liquid bypass control valve 16B, such that the discharge temperature becomes equal to or lower than the threshold value, specifically in this embodiment, becomes equal to the threshold value, as a function of a difference between the discharge temperature and the threshold value. Specifically, the liquid-bypass control unit 357 regulates the opening degree by PID control. The use of PID control enhances the responsiveness of the discharge temperature regulation, but a control method is not particularly limited.

The gas-bypass control unit 358 is configured to acquire the information of the evaporation pressure of the refrigerant having flown out from the evaporator 14 from the evaporation-pressure acquisition unit 354 as described above, and to control the gas bypass control valve 17B based on the acquired evaporation pressure information.

In detail, when the revolutions of the compressor 11 is lowered to the lower limit value and the evaporation pressure of the refrigerant falls below the target evaporation pressure, the gas-bypass control unit 358 in this embodiment opens the gas bypass control valve 17B such that the evaporation pressure of the refrigerant becomes equal to or higher than the target evaporation pressure. When opening the gas bypass control valve 17B, the gas-bypass control unit 358 regulates an opening degree of the gas bypass control valve 17B as a function of a difference between the evaporation pressure of the refrigerant and the target evaporation pressure. Specifically, the gas-bypass control unit 358 regulates the opening degree by PID control. However, a control method of the gas bypass control valve 17B is not particularly limited.

(Operation Upon Control of Refrigeration Apparatus)

Next, an example of an operation of the controller 30 as structured above which controls the refrigeration apparatus 10 is described.

Figure 3A:
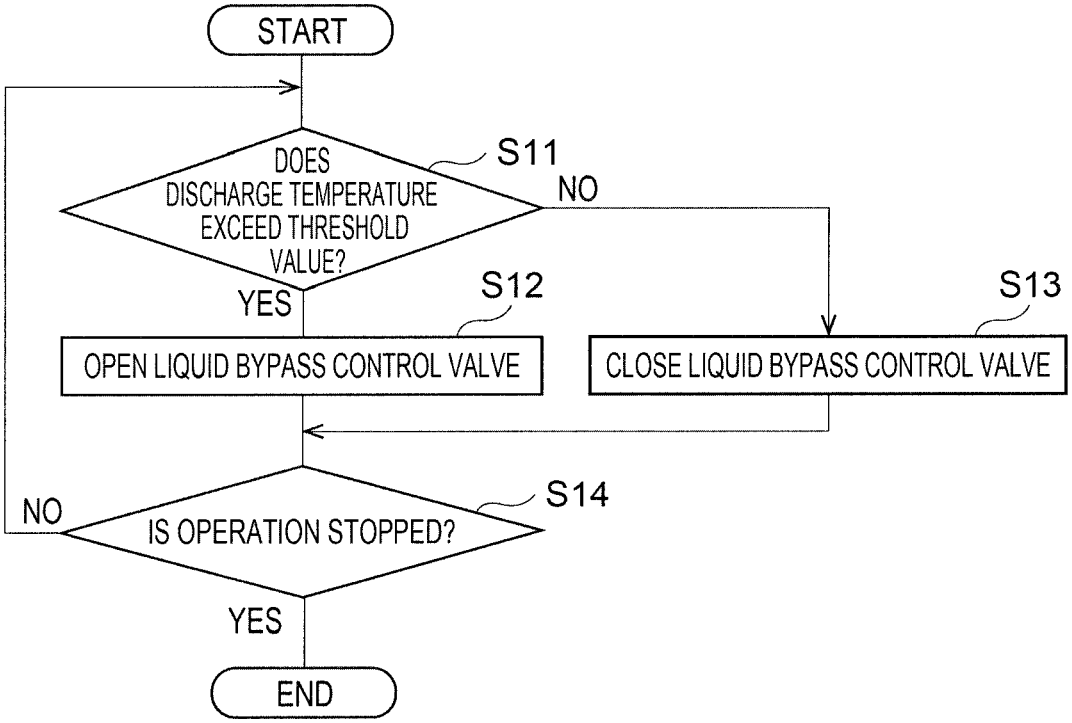
FIG. 3A is a flowchart describing an example of an operation of the controller constituting the temperature control system shown in FIG. 1, when the controller controls a liquid bypass control valve of a refrigeration apparatus.
Figure 3B:
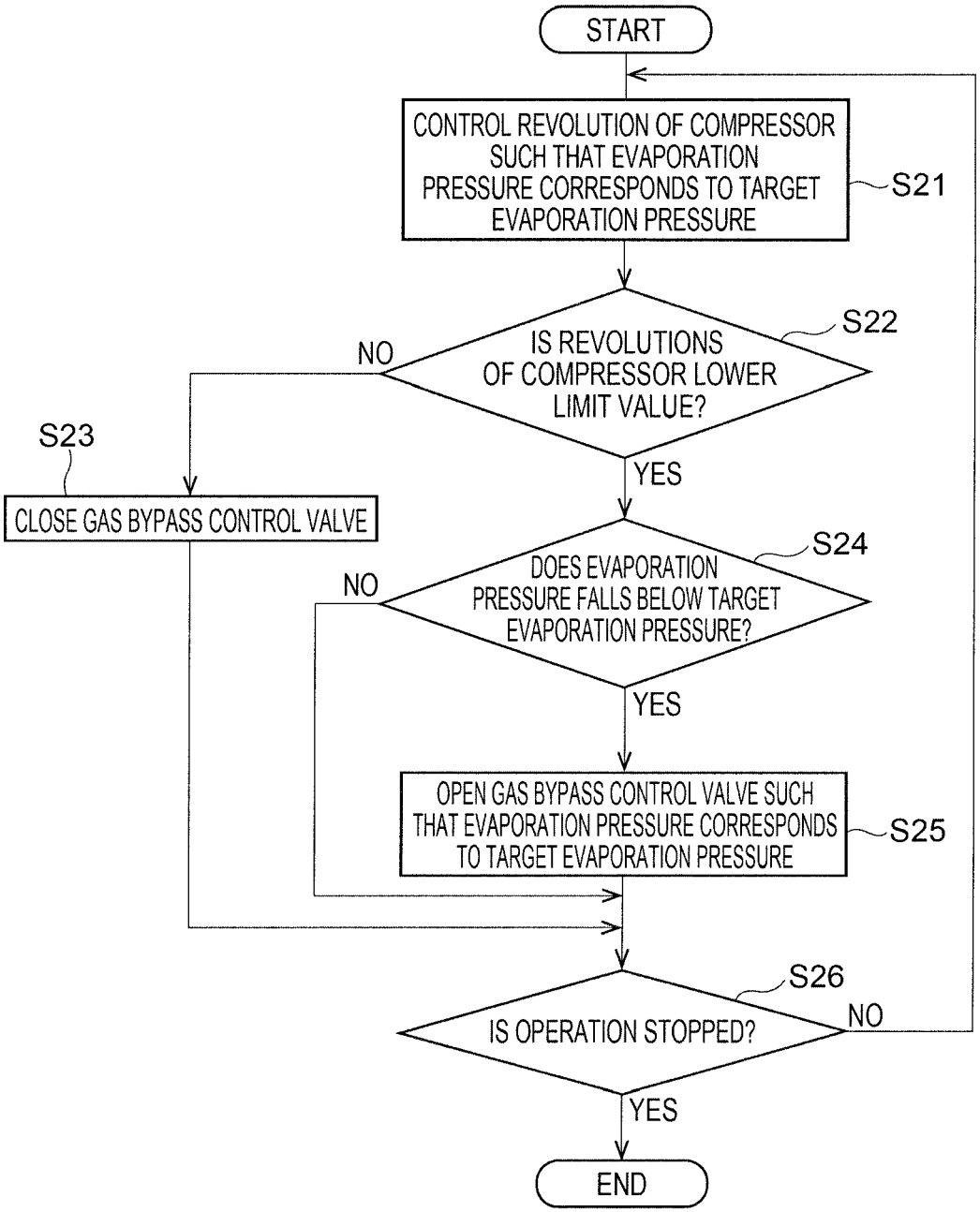
FIG. 3B is a flowchart describing an example of an operation of the controller constituting the temperature control system shown in FIG. 1, when the controller controls revolutions of a compressor of the refrigeration apparatus and a gas bypass control valve thereof.

FIG. 3A is a flowchart describing an example of an operation that controls the liquid bypass control valve 16B. FIG. 3B is a flowchart describing an example of an operation that controls revolutions of the compressor 11 and the gas bypass control valve 17B.

The controller 30 in this embodiment is configured to perform control of the liquid bypass control valve 16B, and control of revolutions of the compressor 11 and the gas bypass control valve 17B in parallel, in other words, in separate loops.

In this embodiment, the controller 30 first activates the refrigeration apparatus 10 by controlling revolutions of the compressor 11 to a reference speed. After the activation, the control of the liquid bypass control valve 16B, which is shown in FIG. 3A, and the control of the revolutions of the compressor 11 and the gas bypass control valve 17B, which is shown in FIG. 3B, are started.

In the control of the liquid bypass control valve 16B shown in FIG. 3A, as shown in a step S11, the controller 30 monitors whether a discharge temperature of the refrigerant based on the information from the discharge temperature sensor 18 exceeds a threshold value.

When the step S11 determines that the discharge temperature exceeds the threshold value (YES), the controller 30 opens the liquid bypass control valve 16B by the liquid-bypass control unit 357 in a step S12. At this time, the liquid-bypass control unit 357 regulates an opening degree of the liquid bypass control valve 16B by PID control such that the discharge temperature becomes equal to or less than the threshold value as a function of a difference between the discharge temperature and the threshold value.

On the other hand, when the step S11 determines that the discharge temperature does not exceed the threshold value, i.e., that the discharge temperature is equal to or less than the threshold value (NO), the controller 30 closes the liquid bypass control valve 16B in a step S13. At this time, when the liquid bypass control valve 16B is opened, the liquid bypass control valve 16B is closed, or when the liquid bypass control valve 16B is closed, the liquid bypass control valve 16B is kept closed.

After the processes of the step S11 and the step S12, the controller 30 monitors whether an operation stop command of the refrigeration apparatus 10 is generated in a step S14. When the operation stop command is generated (YES), the controller 30 stops the operation of the refrigeration apparatus 10 (END). On the other hand, when the operation stop command is not generated (NO), the process returns to the step S11 and the monitoring of the discharge temperature is performed.

On the other hand, in the control of the revolutions of the compressor 11 and the gas bypass control valve 17B, the controller 30 first regulates the revolutions of the compressor 11 by the compressor control unit 356 in a step S21, such that an evaporation pressure of the refrigerant corresponds to a target evaporation pressure. During the revolution regulation, when the evaporation pressure of the refrigerant exceeds the target evaporation pressure, the revolutions of the compressor 11 is increased, or when the evaporation pressure of the refrigerant falls below the target evaporation pressure, the revolutions of the compressor 11 is decreased.

After the revolution regulation in the step S21, the controller 30 determines whether the revolutions of the compressor 11 is a lower limit value in a step S22. When it is not the lower limit value (NO), the controller 30 closes the gas bypass control valve 17B in a step S23. At this time, when the gas bypass control valve 17B is opened, the gas bypass control valve 17B is closed, or when the gas bypass control valve 17B is closed, the gas bypass control valve 17B is kept closed.

On the other hand, when the step S22 determines that the revolutions of the compressor 11 is the lower limit value (YES) in step S22, the controller 30 determines whether the evaporation pressure of the refrigerant falls under the target evaporation pressure in a step S24. When the step S24 determines that the evaporation pressure of the refrigerant falls below the target evaporation pressure, the controller 30 controls the gas bypass control valve 17B to open in a step S25 such that the evaporation pressure corresponds to the target evaporation pressure. This increases the evaporation pressure.

After the process of the step S23 and when the evaporation pressure of the refrigerant does not fall under the target evaporation pressure in the step S24, and after the process of the step S25, the controller 30 monitors whether an operation stop command of the refrigeration apparatus 10 is generated in a step S26. When the operation stop command is generated (YES), the controller 30 stops the operation of the refrigeration apparatus 10 (END). On the other hand, when the operation stop command is not generated (NO), the process returns to the step S21.

The processes in FIGS. 3A and 3B described above enable the refrigeration apparatus 10 to avoid a situation in which the discharge temperature of the compressor 11 becomes excessively high and to reduce liquid back risk, while ensuing a proper refrigeration capacity of the evaporator 14.

Namely, when a temperature of the fluid circulated by the fluid circulation apparatus 20 changes (when a load changes), whether the refrigeration capacity is excessive or insufficient is determined from a difference between the detected evaporation pressure and the target evaporation pressure, and the revolutions of the compressor 11 is regulated to ensure a proper refrigeration capacity. In detail, when the detected evaporation pressure exceeds the target evaporation pressure, the refrigeration capacity is determined to be insufficient and the revolutions is increased. When the detected evaporation pressure falls below the target evaporation pressure, the refrigeration capacity is determined to be excessive and the revolutions is decreased. By eliminating the difference between the evaporation pressure and the target evaporation pressure, the controller 30 determines that the proper refrigeration capacity is ensured. The possibility in which the discharge temperature becomes excessively high because a refrigerant having an excessively high pressure flows into the compressor 11 and the possibility in which the discharge temperature becomes excessively high because a refrigerant having a low pressure flows into the compressor 11 to increase a compression ratio can be reduced. The evaporation pressure falling below the target evaporation pressure increases the liquid back risk. However, since the revolutions of the compressor 11 is regulated such that the evaporation pressure is controlled to the target evaporation pressure, the liquid back risk can also be reduced.

In this embodiment, the revolutions of the compressor 11 is regulated such that the evaporation pressure of the refrigerant, which flows through the refrigeration circuit 10A at a position downstream of the evaporator 14 and upstream of the compressor 11, the position being downstream of the downstream-end connection point of the liquid bypass flow path 16A, corresponds to the preset target evaporation pressure. In this structure, when the refrigerant flows from the liquid bypass control valve 16B to a position upstream the compressor 11, the control to the target evaporation pressure is performed with reference to the evaporation pressure of the refrigerant having flown from the liquid bypass control valve 16B, in order to reduce liquid back. Thereby, a reliability of suppressing the liquid back can be improved. As a modification example, it is possible to employ a structure in which the revolutions of the compressor 11 is regulated such that the evaporation pressure of the refrigerant, which flows through the refrigeration circuit 10A at a position downstream of the evaporator 14 and upstream of the compressor 11, the position being upstream of the downstream-end connection point of the liquid bypass flow path 16A, corresponds to the preset target evaporation pressure.

On the other hand, when the evaporation pressure cannot be properly controlled by the above revolution control because of sudden load change, for example, the discharge temperature becomes high. In this case, a suction temperature of the refrigerant into the compressor 11 is decreased by the liquid bypass control valve 16B. Thus, a situation in which the discharge temperature of the compressor 11 becomes excessively high can be avoided. The revolution control to control the evaporation pressure can reduce the number of times of such activations of the liquid bypass control valve 16B. This results in reduction of the liquid back risk.

In this embodiment, the control of the liquid bypass control valve 16B and the control of the revolutions of the compressor 11 and the gas bypass control valve 17B are performed in separate loops, which increases responsiveness of each control. However, these controls may be performed in a series of sequences.

(Operation Upon Control of Fluid Circulation Apparatus)

Figure 4:
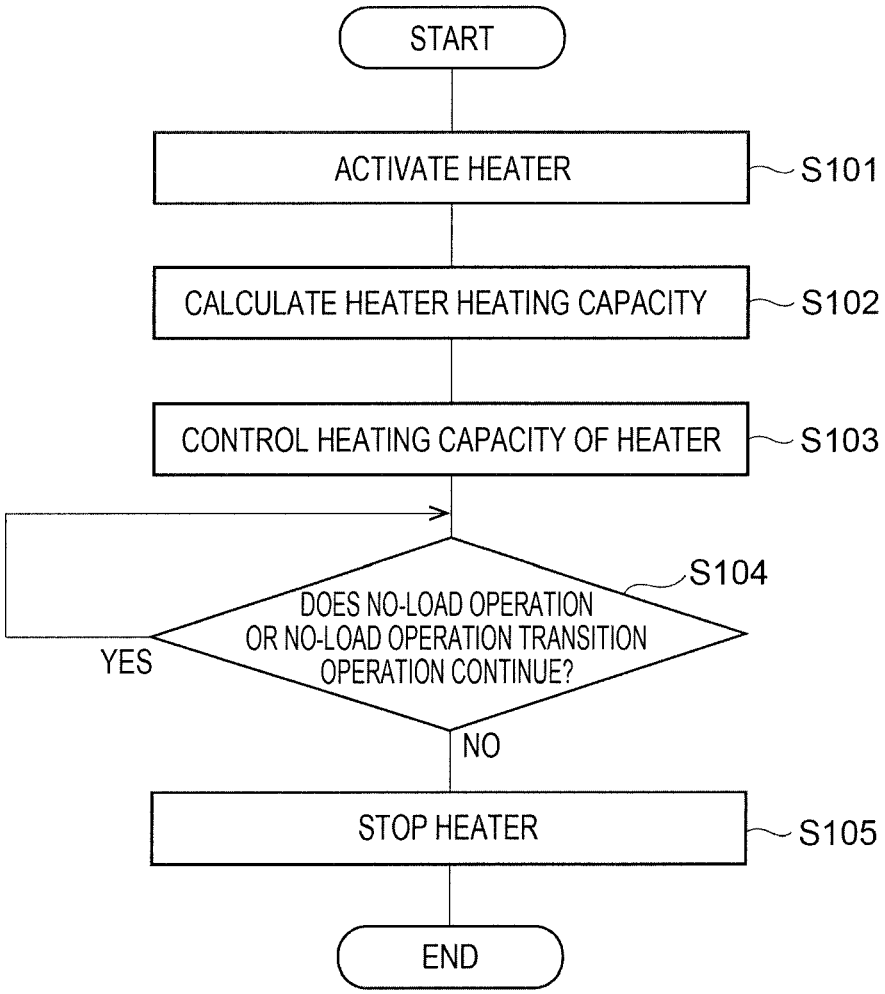
FIG. 4 is a flowchart describing an example of an operation of the controller constituting the temperature control system shown in FIG. 1, when the controller controls a fluid circulation apparatus.

FIG. 4 is a flowchart describing an example of an operation of the controller 30. An example of an operation of the controller (heater control unit 34) is described with reference to FIG. 4.

The operation shown in FIG. 4 is started when the status determination unit 33 determines that the fluid circulation apparatus 20 is in the no-load operation or the no-load operation transition operation. Upon start of the operation, the heater control unit 34 first activates the heater 24 in a step S101.

Then, in a step S102, the heater control unit 34 calculates the heating capacity Q by which the temperature of the fluid to be passed through the evaporator 14 corresponds to the target temperature Tt, in accordance with the above formula (1).

Then, in a step S103, the heater control unit 34 controls the heating capacity of the heater 24 based on the heating capacity Q calculated from the formula (1). Specifically, the heater 24 is controlled such that its heating capacity becomes equal to or more than the heating capacity Q.

Then, in a step S104, the status determination unit 33 monitors whether the no-load operation or the no-load operation transition operation continues. When the no-load operation or the no-load operation transition operation continues, the monitoring is repeated. On the other hand, when it is determined that the no-load operation or the no-load operation transition operation has been exited, the heater control unit 34 stops the heater 24 in a step S105 so that the operation ends.

The fact that the no-load operation or the no-load operation transition operation has been exited can be determined by detecting that a temperature of the fluid, which has passed through the temperature control target T and flows upstream of the heater 24, becomes equal to or more than a predetermined temperature, based on the temperature information detected by the second temperature sensor 26.

In the embodiment described above, when the discharge temperature of the refrigerant, which has been discharged from the compressor 11 and does not yet flow into the condenser 12 exceeds the threshold value, the controller 30 in the refrigeration apparatus 10 opens the liquid bypass control valve 16B. Alternatively, when the discharge temperature is equal to or less than the threshold value, the controller 30 closes the liquid bypass valve 16B. In addition, the controller 30 regulates the revolutions of the compressor 11 such that the evaporation pressure of the refrigerant, which flows through the refrigeration circuit 10A at a position downstream of the evaporator 14 and upstream of the compressor 11, the part being downstream of the downstream-end connection point of the liquid bypass flow path 16A, corresponds to the preset target evaporation pressure.

In this case, when a temperature of the fluid circulated by the fluid circulation apparatus 20 changes (when a load changes), whether the refrigeration capacity is excessive or insufficient is determined from a difference between the detected evaporation pressure and the target evaporation pressure, and the revolutions of the compressor 11 is regulated to ensure a proper refrigeration capacity. In detail, when the detected evaporation pressure exceeds the target evaporation pressure, the refrigeration capacity is determined to be insufficient and the revolutions is increased. When the detected evaporation pressure falls below the target evaporation pressure, the refrigeration capacity is determined to be excessive and the revolutions is decreased. By eliminating the difference between the evaporation pressure and the target evaporation pressure, the controller 30 determines that the proper refrigeration capacity is ensured. On the other hand, the possibility in which the discharge temperature becomes excessively high because a refrigerant having an excessively high pressure flows into the compressor 11 and the possibility in which the discharge temperature becomes excessively high because a refrigerant having a low pressure flows into the compressor 11 to increase a compression ratio can be reduced. The evaporation pressure falling below the target evaporation pressure increases the liquid back risk. However, since the revolutions of the compressor 11 is regulated such that the evaporation pressure is controlled to the target evaporation pressure, the liquid back risk can also be reduced.

The situation in which the evaporation pressure exceeds the target evaporation pressure may occur when a load increases, for example. On the other hand, the situation in which the evaporation pressure falls below the target evaporation pressure may occur when a load decreases, for example.

On the other hand, when the evaporation pressure cannot be properly controlled by the above revolutions control because of sudden load change, for example, the discharge temperature becomes high. In this case, a suction temperature of the refrigerant into the compressor 11 is decreased by the liquid bypass control valve 16B. Thus, a situation in which the discharge temperature of the compressor 11 becomes excessively high can be avoided. The revolution control to control the evaporation pressure can reduce the number of times of such activations of the liquid bypass control valve 16B. This results in reduction of the liquid back risk.

In this embodiment, the control of the evaporation pressure and the reduction in number of times of activations of the liquid bypass control valve 16B reduce the liquid back risk. Thus, a volume of the accumulator can be reduced or the accumulator can be omitted. This can reduce an amount of the refrigerant to be used.

In this embodiment, the activation of the liquid bypass control valve 16B is controlled with reference to the discharge temperature of the refrigerant from the compressor 11. Since this makes it difficult for the liquid bypass control valve 16B to be actuated under the influence of external disturbance, frequent activations can be effectively reduced. This can reduce an amount of use of the refrigerant. There has been a circuit that bypasses a liquid with reference to a suction temperature of the compressor. However, since the suction temperature is liable to change and is susceptible to external disturbance, this structure tends to perform liquid bypass frequently. Thus, a sufficient surplus refrigerant had to be ensured in order that the evaporator can perform proper heat exchange (can ensure refrigeration capacity). The structure of this embodiment can more reduce an amount of use of the refrigerant than such a structure.

Thus, even when a volume of the accumulator is reduced or the accumulator is not used, this embodiment can suitably reduce the liquid back of the refrigerant in the refrigeration apparatus 10, can suitably reduce excessive increase in temperature of the refrigerant to be suctioned into the compressor 11 while reducing an amount of the refrigerant to be used, and can perform a proper cooling operation.

In this embodiment, when the fluid circulation apparatus is determined to be in the no-load operation or the no-load operation transition operation, the controller 30 activates the heater 24 by the heater control unit 34. In this case, it is possible to avoid a possibility that the fluid circulated by the fluid circulation apparatus 20, which has a low temperature, passes through the evaporator 14 so that evaporation of the refrigerant in the refrigeration apparatus 10 is insufficient (i.e., the evaporation pressure lowers). As a result, occurrence of liquid back can be avoided. Thus, even when a volume of the accumulator is reduced or the accumulator is not used, liquid back of the refrigerant in the refrigeration apparatus 10 can be suitably reduced. This results in making compact the temperature control system 1.

(Amount of Use of Refrigerant)

As described above, the refrigeration apparatus 10 according to this embodiment can suitably reduce excessive increase in temperature of the refrigerant to be suctioned into the compressor 11 while reducing an amount of the refrigerant to be used, and can perform a proper cooling operation. Specifically, the present inventor(s) has confirmed that a proper operation can be performed when a fill rate (Kg) of the refrigerant is 0.155×P or more and 0.222×P or less, wherein P represents a rating refrigeration capacity (Kw) of the refrigeration apparatus 10. The present inventor(s) knows that a general refrigeration apparatus having an accumulator and a receiver tank uses a refrigerant of (1.2×P) Kg or more, wherein P represents a rating refrigeration capacity (Kw). As compared with this, the refrigeration apparatus 10 according to this embodiment can significantly reduce an amount of the refrigerant to be used. In more detail, the refrigeration apparatus 10 according to this embodiment having a rating refrigeration capacity of 4.5 (Kw) can perform a proper operation when a fill rate of the refrigerant is 0.70 Kg or more and 1.0 Kg or less. The present inventor(s) manufactured and operated the refrigeration apparatus 10 according to the above embodiment wherein a rating refrigeration capacity was 4.5 (Kw) and a filling amount of the refrigerant was 0.75 Kg, and confirmed that there was no fault heretofore.

The aforementioned rating refrigeration capacity is calculated based on JIS B 8621:2011.

The embodiment of the present invention has been described above, but the present invention is not limited to the aforementioned embodiment and the above embodiment can be variously modified.

For example, in the above embodiment, when the fluid circulation apparatus 20 is determined to be in the no-load operation or the no-load operation transition operation, the controller 30 activates the heater 24 by the heater control unit 34. This embodiment can be replaced with an embodiment in which when a return temperature of the fluid, which flows downstream of the heater 24 and does not yet pass through the evaporator 14, is lower than the target temperature set by the temperature setting unit 31, the controller 30 may activate the heater 24 by the heater control unit 34 to heat the fluid by the heater 24. Namely, when the liquid back risk signal described in the above embodiment is generated, the controller 30 may activate heater 24.

In such a modification example, the heater control unit 34 of the controller 30 may calculate a heating capacity Q by which a return temperature Tb corresponds to a target temperature Tt from the following formula (2).

$$Q=m\times Cp\times(Tt-Tb) \quad (2)$$

Here, Tb represents a return temperature (° C.), Tt represents a target temperature (° C.), and m represents a weight flow rate (kg/s) of the fluid circulated by the fluid circulation apparatus 20, and Cp represents a specific heat (J/kg° C.) of the fluid.

Then, the controller 30 may control the heating capacity of the heater based on the heating capacity Q calculated from the formula (2). At this time, the heater control unit 34 controls the heating capacity of the heater 24 to be equal to or more than the heating capacity Q calculated from the formula (2).

The invention claimed is:

1. A refrigeration apparatus comprising:

a refrigeration circuit in which a compressor, a condenser, an expansion valve, and an evaporator are connected in this order by a pipe to circulate a refrigerant therethrough;

a liquid bypass circuit having a liquid bypass flow path, which branches off from the refrigeration circuit at a position downstream of the condenser and upstream of the expansion valve to be connected to a position downstream of the evaporator and upstream of the compressor, and a liquid bypass control valve provided on the liquid bypass flow path to control flow of the refrigerant in the liquid bypass flow path; and a controller that controls the liquid bypass control valve and revolutions of the compressor;

wherein:

when a discharge temperature of the refrigerant, which has been discharged from the compressor and does not yet flow into the condenser, exceeds a threshold value, the controller opens the liquid bypass control valve and regulates the revolutions of the compressor such that an evaporation pressure of the refrigerant, which flows through the refrigeration circuit at a position downstream of the evaporator and upstream of the compressor, the position being downstream of a downstream-end connection point of the liquid bypass flow path, corresponds to a preset target evaporation pressure; or when a discharge temperature of the refrigerant, which has been discharged from the compressor and does not yet flow into the condenser, is equal to or less than a threshold value, the controller closes the liquid bypass control valve and regulates the revolutions of the compressor such that an evaporation pressure of the refrigerant, which flows through the refrigeration circuit at a position downstream of the evaporator and upstream of the compressor, the position being downstream of a downstream-end connection point of the liquid bypass flow path, corresponds to a preset target evaporation pressure, wherein:

when the evaporation pressure of the refrigerant exceeds the target evaporation pressure, the controller increases the revolutions of the compressor; or when the evaporation pressure of the refrigerant falls below the target evaporation pressure, the controller decreases the revolutions of the compressor, wherein, the refrigeration apparatus further comprises a gas bypass circuit having a gas bypass flow path, which branches off from the refrigeration circuit at a position downstream of the compressor and upstream of the condenser to be connected to a position downstream of the expansion valve and upstream of the evaporator, and a gas bypass control valve provided on the gas bypass flow path to control flow of the refrigerant in the gas bypass flow path, wherein, when the revolutions of the compressor is lowered to a lower limit value and the evaporation pressure of the refrigerant falls below the target evaporation pressure, the controller opens the gas bypass control valve such that the evaporation pressure of the refrigerant becomes equal to or more than the target evaporation pressure, wherein the controller regulates the opening degree of the liquid bypass control valve by PID control as a function of the difference between the discharge temperature and the threshold value, such that the discharge temperature of the refrigerant becomes equal to or less than the threshold value; and wherein the controller regulates the revolutions of the compressor by PI control, such that the evaporation pressure of the refrigerant corresponds to the target evaporation pressure.

2. The refrigeration apparatus according to claim 1, wherein the refrigeration apparatus has no accumulator.

3. The refrigeration apparatus according to claim 1, wherein the controller regulates an opening degree of the gas bypass control valve as a function of a difference between the evaporation pressure of the refrigerant and the target evaporation pressure.

4. The refrigeration apparatus according to claim 1, wherein a fill rate (Kg) of the refrigerant is 0.155×P (Kw) or more and 0.222×P (Kw) or less, and wherein P (Kw) is a rating refrigeration capacity.

5. The refrigeration apparatus according to claim 1, wherein a rating refrigeration capacity is 4.5 Kw, and a fill rate of the refrigerant is greater than or equal to 0.70 Kg and less than or equal to 1.0 Kg.

6. A control method of a refrigeration apparatus comprising: a refrigeration circuit in which a compressor, a condenser, an expansion valve, and an evaporator are connected in this order by a pipe to circulate a refrigerant therethrough; a liquid bypass circuit having a liquid bypass flow path, which branches off from the refrigeration circuit at a position downstream of the condenser and upstream of the expansion valve to be connected to a position downstream of the evaporator and upstream of the compressor, and a liquid bypass control valve provided on the liquid bypass flow path to control flow of the refrigerant in the liquid bypass flow path; and a gas bypass circuit having a gas bypass flow path, which branches off from the refrigeration circuit at a position downstream of the compressor and upstream of the condenser to be connected to a position downstream of the expansion valve and upstream of the evaporator, and a gas bypass control valve provided on the gas bypass flow path to control flow of the refrigerant in the gas bypass flow path;

the control method comprising the steps of:

operating the refrigeration apparatus;

when a discharge temperature of the refrigerant, which has been discharged from the compressor and does not yet flow into the condenser, exceeds a threshold value, opening the liquid bypass control valve and regulating a revolutions of the compressor such that an evaporation pressure of the refrigerant, which flows through the refrigeration circuit at a position downstream of the evaporator and upstream of the compressor, the position being downstream of a downstream-end connection point of the liquid bypass flow path, corresponds to a preset target evaporation pressure; or when a discharge temperature of the refrigerant, which has been discharged from the compressor and does not yet flow into the condenser, is equal to or less than a threshold value, closing the liquid bypass control valve and regulating a revolutions of the compressor such that an evaporation pressure of the refrigerant, which flows through the refrigeration circuit at a position downstream of the evaporator and upstream of the compressor, the position being downstream of a downstream-end connection point of the liquid bypass flow path, corresponds to a preset target evaporation pressure, when the evaporation pressure of the refrigerant exceeds the target evaporation pressure, increasing the revolutions of the compressor; or when the evaporation pressure of the refrigerant falls below the target evaporation pressure, decreasing the revolutions of the compressor, when the revolutions of the compressor is lowered to a lower limit value and the evaporation pressure of the refrigerant falls below the target evaporation pressure, opening the gas bypass control valve such that the evaporation pressure of the refrigerant becomes equal to or more than the target evaporation pressure, regulating the opening degree of the liquid bypass control valve by PID control as a function of the difference between the discharge temperature and the threshold value, such that the discharge temperature of the refrigerant becomes equal to or less than the threshold value; and regulating the revolutions of the compressor by PI control, such that the evaporation pressure of the refrigerant corresponds to the target evaporation pressure.

7. A temperature control system comprising:

the refrigeration apparatus according to claim 1; and a fluid circulation apparatus that sends a fluid, which has heat-exchanged in the evaporator, to a temperature control target, and returns the fluid, which has passed through the temperature control target, to the evaporator for further heat-exchange, the fluid circulation apparatus having a heater at a position downstream of the temperature control target and upstream of the evaporator.

8. The temperature control system according to claim 7, wherein the controller also controls the fluid circulation apparatus, and when the fluid circulation apparatus is in a no-load operation that is a status in which the fluid and the temperature control target do not heat-exchange, or in a no-load operation transition operation that is a status in the course of transitioning into the no-load operation, the controller activates the heater to heat the fluid by the heater.

9. A refrigeration apparatus comprising:

a refrigeration circuit in which a compressor, a condenser, an expansion valve, and an evaporator are connected in this order by a pipe to circulate a refrigerant therethrough;

a liquid bypass circuit having a liquid bypass flow path, which branches off from the refrigeration circuit at a position downstream of the condenser and upstream of the expansion valve to be connected to a position downstream of the evaporator and upstream of the compressor, and a liquid bypass control valve provided on the liquid bypass flow path to control flow of the refrigerant in the liquid bypass flow path; and a controller that controls the liquid bypass control valve and a revolutions of the compressor;

wherein:

when a discharge temperature of the refrigerant, which has been discharged from the compressor and does not yet flow into the condenser, exceeds a threshold value, the controller opens the liquid bypass control valve and regulates the revolutions of the compressor such that an evaporation pressure of the refrigerant, which flows through the refrigeration circuit at a position downstream of the evaporator and upstream of the compressor, the position being upstream of a downstream-end connection point of the liquid bypass flow path, corresponds to a preset target evaporation pressure; or when a discharge temperature of the refrigerant, which has been discharged from the compressor and does not yet flow into the condenser, is equal to or less than a threshold value, the controller closes the liquid bypass control valve and regulates the revolutions of the compressor such that an evaporation pressure of the refrigerant, which flows through the refrigeration circuit at a position downstream of the evaporator and upstream of the compressor, the position being upstream of a downstream-end connection point of the liquid bypass flow path, corresponds to a preset target evaporation pressure;

wherein:

when the evaporation pressure of the refrigerant exceeds the target evaporation pressure, the controller increases the revolutions of the compressor; and when the evaporation pressure of the refrigerant falls below the target evaporation pressure, the controller decreases the revolutions of the compressor, wherein, the refrigeration apparatus further comprises a gas bypass circuit having a gas bypass flow path, which branches off from the refrigeration circuit at a position downstream of the compressor and upstream of the condenser to be connected to a position downstream of the expansion valve and upstream of the evaporator, and a gas bypass control valve provided on the gas bypass flow path to control flow of the refrigerant in the gas bypass flow path, and wherein, when the revolutions of the compressor is lowered to a lower limit value and the evaporation pressure of the refrigerant falls below the target evaporation pressure, the controller opens the gas bypass control valve such that the evaporation pressure of the refrigerant becomes equal to or more than the target evaporation pressure, wherein the controller regulates the opening degree of the liquid bypass control valve by PID control as a function of the difference between the discharge temperature and the threshold value, such that the discharge temperature of the refrigerant becomes equal to or less than the threshold value; and wherein the controller regulates the revolutions of the compressor by PI control, such that the evaporation pressure of the refrigerant corresponds to the target evaporation pressure.

* * * * *